United States Patent [19]

Troncoso

[11] Patent Number: 4,656,747

[45] Date of Patent: Apr. 14, 1987

[54] ARCHERY BOWSTRING PEEP SIGHT

[76] Inventor: Vincent F. Troncoso, 14090-6100 Rd., Montrose, Colo. 81401

[21] Appl. No.: 790,894

[22] Filed: Oct. 24, 1985

[51] Int. Cl.[4] ..... F41G 1/46

[52] U.S. Cl. ..... 33/265; 124/87; 124/90

[58] Field of Search ..... 33/265; 124/87, 90, 124/24 R; 24/114.5, 135 R, 135 N, 459

[56] References Cited

U.S. PATENT DOCUMENTS

| | | | |
|---|---|---|---|
| 209,233 | 10/1878 | Cox | 24/135 |
| 295,252 | 3/1884 | Hutchins | 24/114.5 |
| 947,992 | 2/1910 | Jegge | 24/459 |
| 1,298,898 | 4/1919 | Collier | 24/114.5 |
| 1,402,450 | 1/1922 | Setty | 24/114.5 |
| 2,900,617 | 8/1959 | Hixon | 24/135 R |
| 3,410,644 | 11/1968 | McLendon | 33/265 |
| 3,703,770 | 11/1972 | Sofield | 33/265 |
| 3,703,771 | 11/1972 | Saunders | 33/265 |
| 4,116,194 | 9/1978 | Topel | 33/265 |

FOREIGN PATENT DOCUMENTS

| | | | |
|---|---|---|---|
| 1300273 | 6/1961 | France | 24/459 |

*Primary Examiner*—Charles Frankfort
*Assistant Examiner*—Patrick R. Scanlon
*Attorney, Agent, or Firm*—Donald E. Nist

[57] ABSTRACT

The bowstring peep sight is inexpensive and durable and can be easily, rapidly and securely connected to the bowstring of a compound or non-compound archery bow without having to serve locking knots on the bowstring as with conventional peep sights. The peep sight is particularly useful with compound archery bows where the close proximity of multiple segments of bowstring to each other renders the serving of knots difficult and time consuming. Serving knots can slip, whereas the present peep sight is positively locked but easily loosenable and/or removable from the bowstring. The peep sight has a body defining a tapered peep and a peripheral string groove. The body may be partly cut away to expose the string groove to one or more movable connector plates which can be screwed thereagainst. Instead, the main body can be split into front and rear plates releasably secured against each other by external or internal screws, or have studs press-fittable into mating openings, trapping the bowstring therebetween. A peep insert can also be press-fitted into the peep to decrease its diameter.

3 Claims, 13 Drawing Figures

ARCHERY BOWSTRING PEEP SIGHT

BACKGROUND OF THE INVENTION

1. Field of the Invention

The present invention generlly relates to sports equipment and more particularly to an improved archery bowstring peep sight.

2. Prior Art

Conventional archery bowstring peep sights comprise generally oval plastic bodies having peripheral string grooves and central peeps. A peep sight must be connected to the bowstring by dividing the strands of the bowstring into two sets longitudinally then inserting the peep sight therebetween, with the bowstring strands in the peep sight grooves, and then serving the bowstring with additional string to form knots at both ends of the peep sight in order to pull the bowstring strands tightly together and solidly hold the peep sight in place. The knots are usually locked in place with quick-setting glue or cement.

If and when it is desired to move the peep sight, as when another archer uses the bow, the knots must be stripped off and laboriously reapplied. Frequently such knots loosen and slip, allowing the peep sight undesirably to travel on the bowstring and to fall out during shooting of the bow. The purpose of the peep sight is twofold: to sharpen the image of the target; and also, to precisely position the bow and bowstring relative to the archer from shot-to-shot in order to increase the archer's uniformity of form and thus his or her shooting accuracy. If and when the peep sight substantially slips on the bowstring, shooting accuracy inevitably declines as a result of having to reposition the bow and bowstring relative to the archer in order to see out of the peep sight. When the peep sight is only slightly displaced, viewing clarity may decrease without the archer even realizing it, because the viewing is not through the center of the sight. Accordingly, it is important to securely lock the peep sight to the bowstring.

The peep sight also adds a small amount of drag to the bowstring, which drag is increased by the presence of serving knots and layers of anchoring adhesives. Any drag slows the bowstring speed and affects arrow flight.

Accordingly, there is a need for a peep sight which will minimize drag and which can be securely locked in place on a bowstring very rapidly, easily and simply, and just as easily removed from or shifted on the bowstring, all without the use of serving knots, anchorihg glue and special tools. Such a peep sight should be capable of being fabricated in a variety of sizes and forms and provide improved viewing clarity as well as maximum convenience, whether the bow is a compound bow or not.

SUMMARY OF THE INVENTION

The improved archery bow peep sight of the present invention satisfies all the foregoing needs. The peep sight is substantially as set forth in the Abstract. Thus, the peep sight comprises a body having a peripheral bowstring groove and a peep hole extending through the body generally perpendicular to the plane of the groove. The peep sight includes a movable connector connected to the body and which can be screwed or otherwise forced against the bowstring while it is in the groove, in order to rapidly, simply and easily lock the peep sight in place on the bowstring. The peep sight can just as easily be removed from or repositioned on the bowstring, when it is desired to do so, as when retuning the bow.

In one embodiment, one or a pair of spaced plates span the peripheral groove in a cutaway portion of the main body and are forced into bowstring contact by a screw. In another embodiment, the main body is split into front and back plates which are threaded together with external or internal screws or press fitted or the like to sandwich the bowstring therebetween and releasably lock the peep sight to the bowstring.

In a further embodiment, a peep insert is provided to change the diameter of the peep hole and thus the sharpness of the viewed target image. Further features of the present invention are set forth in the following detailed description and accompanying drawings.

DRAWINGS

FIGS. 1–3

Figure 1:
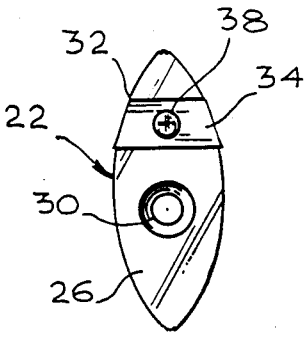
FIG. 1 is a schematic front elevation of a first preferred embodiment of the improved archery bowstring peep sight of the present invention.
Figure 2:
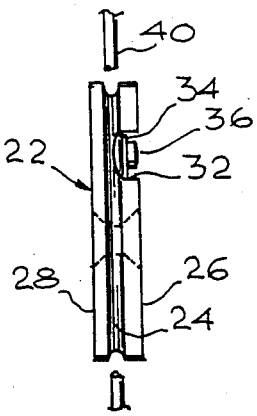
FIG. 2 is a schematic side elevation of the peep sight of FIG. 1.
Figure 3:
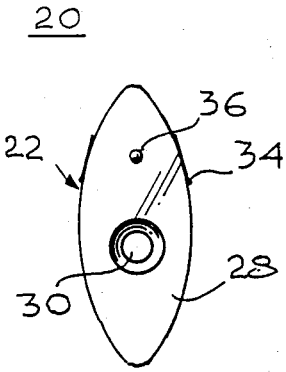
FIG. 3 is a schematic rear elevation of the peep sight of FIG. 1.

A first preferred embodiment of the peep sight of the present invention is schematically depicted in FIGS. 1–3. Thus, archery bowstring peep sight 20 is shown which comprises a solid body 22 which is generally flat and oval in outline, with an archery bowstring groove 24 in its entire outer periphery between its flat front 26 and flat rear 28. Groove 24 is generally parallel to front 26 and rear 28.

Body 22 also includes a peep hole 30 which extends therethrough from front 26 to rear 28 geherally perpendicular to groove 24 and which is circular in transverse cross-section but which tapers down from both its front and rear to its narrow central portion (see dotted outline in FIG. 2). Preferably, body 22 is of plastic or other lightweight material (wood, anodized aluminum, ceramic, etc.) and is non-glaring, especially in the area around and defining peephole 30.

A movable locking component is releasably secured in a transverse cut-away portion 32 in front 26 which exposes opposite side portions of groove 24. Such component comprises a thin plate 34 of aluminum, steel, plastic or the like, releasably held in body 22 by a screw 36 projecting therethrough, the head 38 of which screw 36 projects up from front 26 for easy access. Plate 34 can be screwed down by screw 36 to tightly trap a bowstring 40 (FIG. 2) in groove 24 against plate 34 and body 22 so as to simply, easily and rapidly releasably lock peep sight 20 to bowstring 40. When it is desired to move peep sight 20 on bowstring 40 or remove it entirely therefrom, screw 36 and plate 34 can be loosened or removed to free bowstring 40. Thus, peep sight 20 is adjustable, easy to install and remove, simple, inexpensive, durable and effective.

Figure 4:
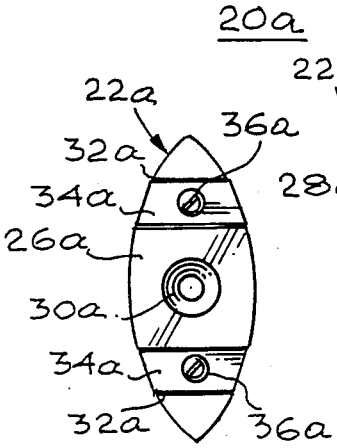
FIG. 4 is a schematic front elevation of a second preferred embodiment of the improved archery bowstring peep sight of the present invention.
Figure 5:
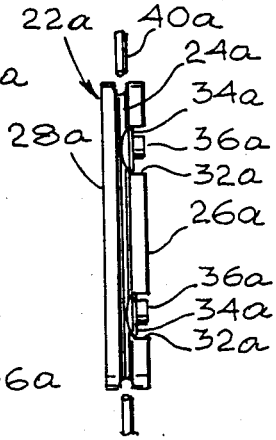
FIG. 5 is a schematic side elevation of the peep sight of FIG. 4.

FIGS. 4 and 5

A second preferred embodiment of the present peep sight is depicted in FIGS. 4 and 5. Thus, peep sight **20*a* is shown. Components thereof similar to those of peep sight 20 bear the same numerals but are succeeded by the letter "a". Peep sight 20*a* differs from peep sight 20 only in that it includes a pair of parallel cutaway portions 32*a* in front 26*a* at opposite ends of body 22*a*, exposing groove 24*a* and bowstring 40*a* and in which a pair of plates 34*a* and screws 36*a* are disposed. Peep hole 30*a* extends from front 26*a* to rear 28*a*. Peep sight 20*a* functions similarly to and has the advantages of peep sight 20**.

Figure 6:
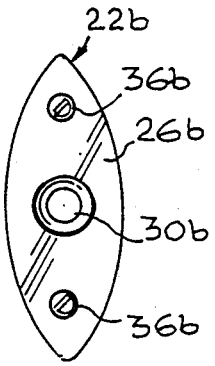
FIG. 6 is a schematic front elevation of a third preferred embodiment of the improved archery bowstring peep sight of the present invention.
Figure 7:
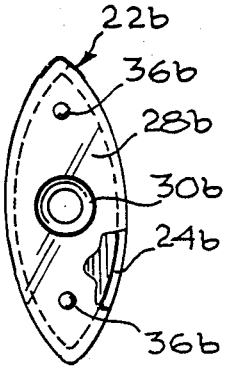
FIG. 7 is a rear elevation, partly broken away, of the peep sight of FIG. 6.
Figure 8:
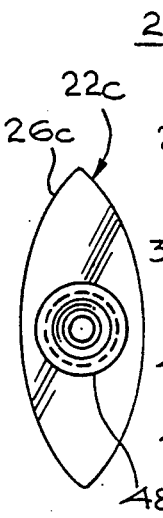
FIG. 8 is a schematic front elevation of a fourth preferred embodiment of the improved archery bowstring peep sight of the present invention.
Figure 9:
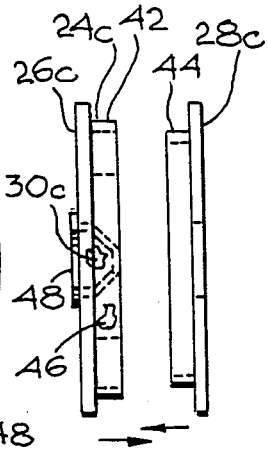
FIG. 9 is a schematic side elevation, partly broken away, of the peep sight of FIG. 8 in the component separated condition.
Figure 11:
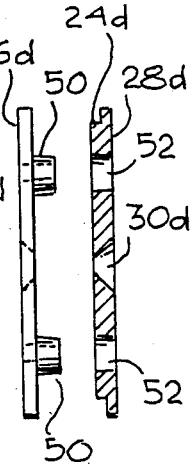
FIG. 11 is a schematic side elevation, partly in section, of the peep sight of FIG. 10 in the component separated condition.
Figure 12:
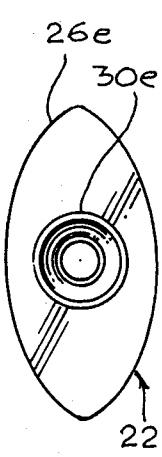
FIG. 12 is a schematic front elevation of a sixth preferred embodiment of the improved archery bowstring peep sight of the present invention; and, FIG. 13 is a schematic side elevation, partly in section, of the peep sight of FIG. 12 in the component separated condition.
Figure 13:
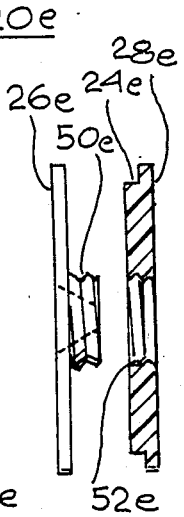

FIGS. 6 and 7 depict a third preferred embodiment (peep sight **20*b*) of the present invention, FIGS. 8 and 9 a fourth preferred embodiment (peep sight 20*c*), FIGS. 20 and 11 a fifth preferred embodiment (peep sight 20*d*) and FIGS. 12 and 13 a sixth preferred embodiment (peep sight 20*e*). Components thereof similar to those of peep sight 20 bear the same numerals as those of peep sight 20 but are followed by the respective letters "b" for peep sight 20*b*, "c" for peep sight 20*c*, "d" for peep sight 20*d* and "e" for peep sight 20*e***.

FIGS. 6 and 7

In FIGS. 6 and 7, peep sight **20*b* is shown which differs from peep sight 20 only in that body 22*b* is split parallel to the front surface of body 22*b* to form two separate parallel stacked plates 26*b* and 28*b* defining groove 24*b* and bearing peep hole 30*b*. Plates 26*b* and 28*b* are releasably screwed together by screws 36*b* extending therethrough to tightly grip a bowstring (not shown) in groove 24*b***.

FIGS. 8 and 9

Peep sight **20*c* differs from peep sight 20*b* in that it includes a hollow tube 42 projecting rearwardly from plate 26*c* within which a similar hollow tube 44 projecting forwardly from plate 28*c* is releasably frictionally received so as to hold plates 26*c* and 28*c* together and define groove 24*c* therebetween. Tube 42 has a solid central portion 46 within which tapered peep hole 30*c* is defined. An optional front insert 48 can be releasably frictionally fitted into hole 30*c*, if desired, to reduce its diameter. Insert 48** can be, for example, of rubber, plastic or the like.

Figure 10:
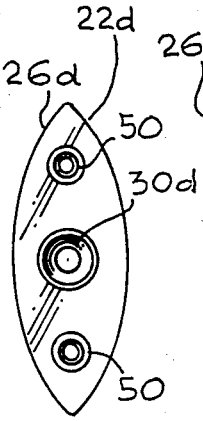
FIG. 10 is a schematic front elevation of a fifth preferred embodiment of the improved archery bowstring peep sight of the present invention.

FIGS. 10 and 11

Peep sight **20*d* differs from peep sight 20*b* only in that a pair of spaced rearwardly extending tubular studs 50 are connected to front plate 26*d* and press-fittable into mating openings 52 in rear plate 28*d* of body 22. Peep hole 30*d* continues through plates 26*d* and 28*d* and has the configuration shown in FIG. 11. Groove 24*d* is shallow and defined in the periphery of plate 28*d***.

FIGS. 11 and 12

Peep sight **20*e* differs-from peep sight20*d* only in that peep hole 30*e* is defined in plate 26*e* and in a hollow tubular centrally disposed stud 50*e* extending rearwardly from plate 26*e*. Stud 50*e* is externally threaded and receivable within a central internally threaded opening 52*e* in rear plate 28*e*. Plate 28*e* has a shallow peripheral front bowstring groove 24*e*. To lock body 22*e* in place on a bowstring, the string is placed in groove 24*e* and plate 26*e* is then screwed into plate 28*e* to squeeze the bowstring therebetween. If desired, body 20*e* can be circular instead of oval in outline. Peep sight 20*e* has the advantages of peep sight 20, as do peep sights 20*b*, 20*c* and 20*d***. All such peep sights can be made of similar materials.

Various other modifications, changes, alterations and additions can be made in the improved archery bowstring peep sight of the present invention, its components and their parameters. All such modifications, changes, alterations and additions as are within the scope of the appended claims form part of the present invention.

What is claimed is:

1. An improved archery bowstring peep sight, said sight comprising, in combination:

a. a generally oval peep sight body having a peripheral bowstring groove therearound, a tapered peep opening extending through said body substantially perpendicular to the plane of said groove and a transverse cutaway portion spanning said peep sight body and exposing said groove; and, b. a movable connector comprising a pressure plate spanning said peep sight body in said cutaway portion and in contact with said groove, and securing means releasably securing said plate to said body in said cutaway portion for bearing against a bowstring when said bowstring is in said groove to releasably lock said peep sight to said bowstring.

2. The improved peep sight of claim 1 wherein a second transverse cutaway portion is provided, said two transverse cutaway portions being disposed at opposite ends of said peep sight body, each said cutaway portion having a separate said pressure plate and securing means.

3. The improved peep sight of claim 1 wherein said peep sight comprises hardened molded plastic and said connector plate and said receiving means comprise metal.

* * * * *